US005588379A

United States Patent [19]

Witteveen

[11] Patent Number: 5,588,379

[45] Date of Patent: Dec. 31, 1996

[54] MIXING DEVICE AND METHOD FOR GASEOUS LIQUID OF PULVERISED SUBSTANCES

[76] Inventor: Gustaaf J. Witteveen, Stationsstraat 41, 6584 AS Molenhoek, Netherlands

[21] Appl. No.: 423,354

[22] Filed: Apr. 18, 1995

Related U.S. Application Data

[63] Continuation of Ser. No. 117,209, filed as PCT/NL92/00055, Mar. 19, 1992 published as WO92/16794, Oct. 1, 1992, abandoned.

[30] Foreign Application Priority Data

Mar. 20, 1991 [NL] Netherlands ..... 9100490

[51] Int. Cl.[6] ..... F23C 7/00; F23D 11/10; B01F 5/00; B05B 7/10

[52] U.S. Cl. ..... 110/262; 431/284; 110/264; 110/347

[58] Field of Search ..... 110/260–265, 347; 431/284

[56] References Cited

U.S. PATENT DOCUMENTS

| | | | |
|---|---|---|---|
| 2,806,517 | 9/1957 | Te Nuyl . | |
| 3,304,012 | 2/1967 | Sem . | |
| 4,473,185 | 9/1984 | Peterson et al. . | |
| 4,555,994 | 12/1985 | Voigt et al. | 110/262 |
| 4,718,359 | 1/1988 | Skoog . | |
| 4,741,279 | 5/1988 | Azuhata et al. | 110/264 |
| 4,807,541 | 2/1989 | Masai et al. | 110/264 |
| 4,838,185 | 6/1989 | Flament | 110/264 |
| 5,127,346 | 7/1992 | Kepplinger et al. | 110/264 |
| 5,203,692 | 4/1993 | Wexoe | 431/284 |

FOREIGN PATENT DOCUMENTS

| | | |
|---|---|---|
| 1223775 | 7/1987 | Canada . |
| 2005006 | 4/1979 | United Kingdom . |

*Primary Examiner*—Marguerite McMahon
*Attorney, Agent, or Firm*—Larson & Taylor

[57] ABSTRACT

Device for mixing gas, liquids or pulverized solid substances with a gas flow (1), whirling (vortex) around an axis in the flow direction. The whirling gas flow is guided through a converging passage (4) and, during or after being charged with the substance, abruptly widens in cylindrical space (11), as a result of which vortex break down occurs and an exceptionally thorough mixing and/or atomizing of the substance is obtained. Application in a burner improves the combustion result, keeps the NOX-values low and prevents the flame from being blown off.

13 Claims, 3 Drawing Sheets

MIXING DEVICE AND METHOD FOR GASEOUS LIQUID OF PULVERISED SUBSTANCES

This application is a continuation of application Ser. No. 08/117,209, filed as PCT/NL92/00055, Mar. 19, 1992 published as WO92/16794, Oct. 1, 1992, now abandoned.

The invention relates to mixing a gas flow with a gaseous, liquid or pulverised substance, such as fuel, where a rotation enforcing body for the gas flow has been devised in order to feed an introduced gas flow to a mainly axially symmetrical tube with an axial component in the axial direction of the tube and with a rotation component relative to the axial direction, while the tube has been tapered down (narrowed) in the direction of the axial component.

Such mixing methods are known in many forms. GB - A - 2005 006 shows a burner that has a mixing method such as the one mentioned above, where the mixing of oil with the combustion air takes place under the effect of high pressure atomization of the oil. Here an extremely strong atomization and mixing of the oil and the combustion air are only obtained to the usual extent and combustion with a low NOX level and little or no excess of air is only obtainable to a limited extent.

U.S. Pat. No. 2,806,517 shows a burner with a rotating combustion air flow which is conducted through a tapering down and in which oil is atomized centrally. In the combustion cone following the tapering down, vortices occur on both sides of the atomization cone of the oil.

The invention is based on the understanding that a gas flow with a strong rotation around the flow axis compared to the axial component, can, with a sudden widening of the flow diameter, induce a sudden and very strong turbulence in the flow, in the following referred to as 'vortex break down'. This vortex break down manifests itself in a shattering or explosion of the jet while forming very strong local turbulence which leads to an extremely thorough mixing of the substances in the flow.

In addition a very stable vortex is created in which a very thoroughly mixed fuel-air mixture can be burnt in a short period of time so that exceptionally low NOX values occur. The same thorough mixing allows complete combustion with virtually no excess of air. As the tangential component increases to the same extent as the axial component with the increase of the gas velocity, blowing off the flame is virtually impossible. Another property of vortex break down is that an axial counter flow is induced, which in the invention flows back through the tapering down and, by doing so, forces the substance that is to be mixed towards the outer side and preferably even against the wall of the tapering down.

In order to build up a turbulence that is suitable for a vortex break down the invention provides that before the tapering down a widening is present.

It is pointed out that the tapering down can consist of a material tapering down of the tube as well as of a gas, which is introduced with a radial component and which compresses the jet in radial direction, or of a radial component of the jet which causes it to be narrowed.

While tapering down a jet rotating around its axis, the energy fed to the jet is being converted into rotation energy by means of the Coriolis forces. As a result the ratio between the rotation component, in particular on the outside of the jet, and the translation component increases. This results in a fall of pressure in the center of the jet, which can lead to underpressure, as a result of which in principle a flow can be created that is directed against the axial direction of the flow.

For preference the invention provides that the tapering down reduces the diameter of the tube to 0.9–0.7 of the diameter prior to the narrowing. Within this range, which is only preferential, vortex break down can in practice be achieved with a in pressure difference for the thrust of the jet from 3 to 5 cm of water (300 to 500 $N/m^2$).

In case of a material tapering down of the flow it is preferably provided that the narrowing includes an angle with the axis of the tube, which angle increases in the direction of the flow.

It is preferably provided that the narrowing includes at its end an angle with the axis of over 50 degrees. Herewith it is pointed out that also in case of acuter angles with the axis at the end of the narrowing good results are to be obtained, but that with angles of 50 degrees to about 60 degrees an adequate rapid compression of the jet can be combined with a short transit time and, therefore, little thrust and formation of micro-turbulence in the rotating flow itself.

In accordance with a further aspect of the invention, it can be provided that the rotation enforcing body is connected only to the outside shell of the tube. This means that the inside area of the jet, which is the area within the outside shell, is also made available to the axial flow of the jet. As a result of which it is possible, while increasing the rotation component of the jet, to cause the total section to become larger because the cross-sectional area of the outside shell is smaller than the total sectional area in the tapering down. This means a decrease of the axial velocity of the flow and, therefore, an increase of the ratio between the rotational component and the axial component of the flow.

In accordance with the invention, it is provided that at the rear side of the tube there is a back surface with an opening for the introduction of the mixing substance. Important is that in the center of the jet an underpressure is created with a counterflow near the axis. This throws the mixing substance towards the back surface. In the process the strong rotation will contribute to the fact that, when the mixing substance is a fluid such as oil, it will move along the surface of this back surface. By this it is achieved that the fluid can be carried along to the areas of the vortex which are located more to the outside, where the velocity of the vortex flow is high so that the liquid can be atomized.

The mixing substance, however, is subject to the strongest atomization and mixing when it is thrown off the edge of the tapering down and enters the vortex break down area. As a result it is possible to obtain a very good atomization of oil, which is introduced under a very low pressure, for instance 5 cm of water.

A further refinement of this is that the back surface is conically widened in the direction of the flow. As a result the gravity component, which has its effect on the mixing substance, is partially compensated by the inclination of the back surface, which ensures a better symmetrical discharge of the mixing substance.

As has been mentioned above, the tapering down need not be a material section reduction of a material tube. Accordingly, an embodiment of the invention provides that the narrowing is formed by a gas flow which, with a radially inward directed component, is introduced to the circumference of the tube. In order to avoid big differences in flow velocity at the confrontation of this gas flow and the whirling gas flow, it will, of course, be ensured that the gas flow which causes the narrowing has a whirling motion and possibly an axial movement as well.

It is also possible to devise the rotation enforcing body in such a manner that the flow itself, leaving the rotation enforcing body, will cause the narrowing. Accordingly, in this case it is provided that the rotation enforcing body is devised to introduce a gas flow with besides the tangential component an inwards directed radial component around the tube and through the cylinder surface of the tube. As has been mentioned above, the vortex break down will occur when the flow section is widened. It is to be recommended that this widening will be abrupt and that the flow section for small burners (up to circa 50 kW) will preferably be enlarged at least five times in relation to that of the tapering down, and for large ones circa 2.5 to 3.5 times.

The above has been found favorable for the operation of a burner which is supplied with the abovedescribed device. Due to the vortex break down, such a burner has an exceptionally thorough mixing of fuel with combustion air in a very short range. In addition, it has been found that in the area direct behind the widening a vortex occurs, which has not only a rotation component around the axis of the flow but also a rotation perpendicular to it, which means that gas is fed back to the back wall of the widening and from there back again to the base of the flame. This means that the base of the flame also receives an already completely or partially burned and cooled off gas mixture, as a result of which the combustion temperature remains lower and, consequently, the formation of nitrogen oxides is countered.

When a burner is operated in such a way that vortex break down occurs, it is possible to ensure that the diameter of the burner cone has such a taper that, past a underpressured space caused by the explosion of the jet, a stable gas body comes into being, which prevents gas flowing back from the end area of the burner cone to the underpressured space. Should the vortex already play an important part in the prevention of the blowing off of the flame direct behind the widening, this above indicated taper of the burner cone, which causes sufficient outflowing gas to be bent inwards, ensures even more the prevention of the blowing off of the flame. It is pointed out that, due to the application of the invention, a large part of the flow energy has the form of turbulence and, as a result, blowing off is actually already countered. In practice, a stable burner of relatively small dimensions can be obtained wherein blowing off the flame is impossible.

Moreover, the formation of nitrogen oxides can be countered by providing that the back wall of the burner cone is cooled.

Furthermore, the created vortex at the widening near the burner can be employed by installing the burner cone near its back surface an inlet slot for air, residual gas and waste gas that is to be destroyed by combustion. This slot pulls one of the gases towards the center, where cool air ensures a reduction in temperature of the flame base.

In order to provide a burner wherein the invention is applied and that is controllable, it will be clear that the air velocity, also in a lower setting and resulting, therefore, in a limited air supply, has to meet minimum requirements. Accordingly, amplification of the invention provides that a controllable air tap of the air that passed through the rotation enforcing body is present.

As will be further discussed below, an analytical examination of the flow before and past the tapering down, indicates that no solutions exist for a continuous flow in case of a adequate high vortex intensity and a widening of the flow section. The result of this examination is that, when the equation:

$$\frac{U_1}{U_o} = 1 + \left( \frac{k^2 r_0^2}{k^2 r_1^2} - 1 \right) \cdot \frac{\frac{k}{2} r_1}{J_1(kr_1)} \cdot J_0(kr_1)$$

wherein $U_0$=axial velocity in the tapering down;

$U_1$=axial velocity in the burner cone;

$k=2\Omega/U_0$ with $\Omega$=the angular velocity and $J_0$ and $J_1$ are Bessel functions of the zeroth and first order, has no real solution, vortex break down is to be expected.

The formulas, however, are developed based on a flow free of turbulence and of dissipation, which, of course, is not entirely consistent with reality so that these formulas give only an indication whether vortex break down will occur.

In the following, the invention is further explained by means of the drawing wherein:

FIG. 1 shows schematically a burner provided with the invention and the flows occurring within;

FIG. 2 indicates schematically the occurrence of the vortex;

Figure 1:
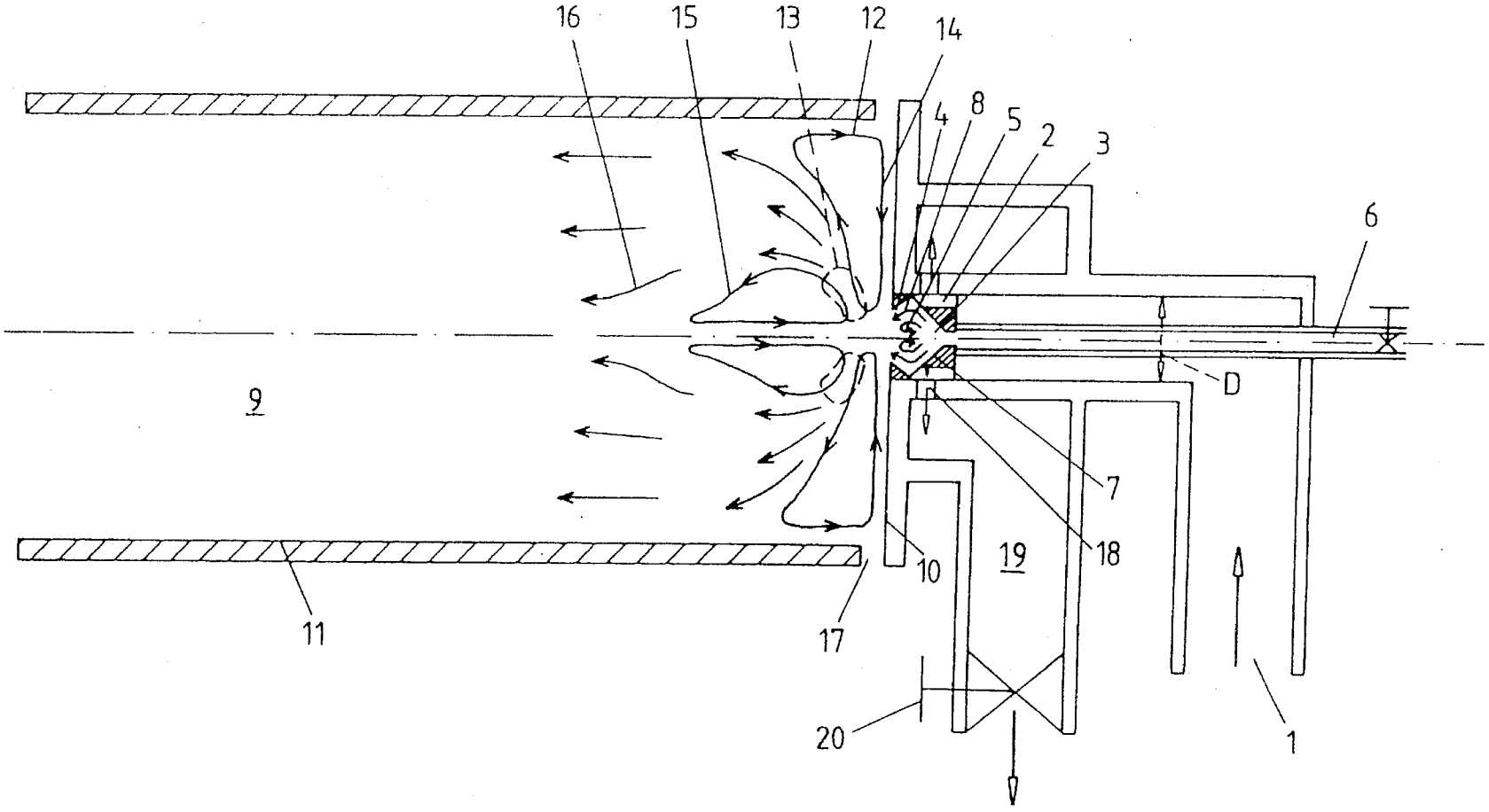

In FIG. 1 an air supply for a burner is indicated by 1 where the air has undergone pressure-increase up to 5 cm of water column or 500 N/m$^2$. This air is introduced through axially and tangentially directed slots 2 to a vortex chamber 3. This vortex chamber has on its exit side a tapering down 4, which causes the air vortex to be even stronger before flowing out. The strong vortex leads to underpressure in the axial area and, therefore, to a counterflow, as is schematically indicated with the flow lines 5.

By means of a central oil feeding line 6, oil is introduced to the conical back surface 7 of the vortex chamber 3. By means of the counterflow and vorticity of the air in the vortex chamber 3, oil is forced out along the cone 7 to reach, via the wall parts between the passages 2, the surface, which tapers towards the opening 4, where the vortex air flow 8 ensures that the oil in a thin film moves along this surface at a relatively high speed. In the tapering down 4 delamination of the oil film takes place, which atomizes directly. Due to the vortex break down, which occurs right after the tapering down 4 in the burner cone 9, an extremely fine atomization takes place. This burner cone has a back surface 10 and a cone wall 11, drawn as a cylinder.

The flow that leaves the vortex chamber 3, explodes while forming a very strong turbulence, as a result of which axially an underpressure is created and a counterflow vortex 12 that flows along the back wall 20 and attaches itself in a stable way to the back wall, partly due to the underpressure created by the local flow velocity.

When the flame is ignited, a very concentrated combustion takes place in the area 13, indicated by a dotted line, the counterflow 14 from the vortex 12, however, provides cooling of the flame. In the central part in front of the discharge area of the flow from the vortex chamber 3, an underpressure occurs and as a result a vortex can occur, as is indicated by 15. This vortex, too, is stable and impossible to be blown off. Because the main flow, as is indicated at 16, moves again to the axis of the burner cone, it is impossible for gas coming from the exhaust area of the burner or even the middle area, to flow back to the area of the flame.

The slot 17 between the burner cone 11 and the back surface 10 may provide a secondary-air supply, if so desired. Moreover, the back surface 10 may be cooled, for instance by water in case the burner is used for the heating of water in, for example, a central heating boiler. In stead of secondary air, residual gas or a gaseous product that is to be burnt may be introduced, in which case the very thorough mixing by the vortex break down ensures a most efficient combustion.

As the rotation velocity is only allowed to decrease a little or not at all, in order to obtain vortex break down by means of controlling the burner, a control may be obtained by bringing the combustion air at full speed and subsequently feeding-back part of this air, as is schematically indicated by the slots 18 that give access to a space 19 that has an air exhaust through a control cock 20.

In accordance with this drawing, the burner has not only a high stability in order to prevent blowing off and an exceptionally thorough mixing of combustion air and fuel and, therefore, a short flame, it also ensures that a mixture containing oxygen and nitrogen is at a high temperature for a short while only. This is an additional reason why this burner emits few nitrogen oxides.

The drawn vortex chamber 3 receives its rotating gas through the slots 2. The axial velocity of the air flowing out, is now inversely proportional to the sectional area of the annular slot zone 2 and the circular exhaust in the tapering down. It is very well possible that the latter may be larger than the section of the annular slot, in which case the axial velocity is lower when flowing out of the vortex chamber than when entering it, which increases even further the ratio between the rotation velocity and the axial velocity.

Figure 2:
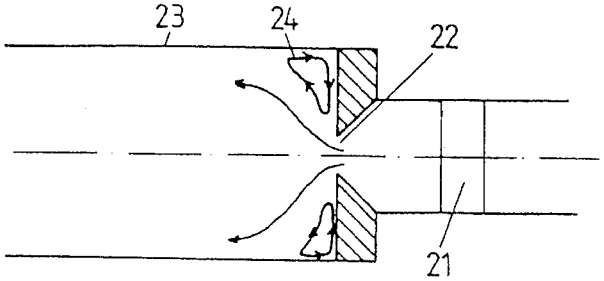

FIG. 2 schematically shows the situation in which a rotation enforcing body 21 causes a vortex with everywhere the same angular velocity around the axis (solid body vortex). This vortex is carried via the tapering down 22 to a more spacious flow tube 23, in the process of which vortex break down occurs again and also the annular vortex 24. This device, too, causes an exceptionally intensive intermixing of the gas flow, for instance, when it contains a mixing gas, a mixing fluid or pulverized particles. In addition, it is pointed out that the invention is most suitable for the combustion of pulverized fuel such as coal particles, but also of aluminium that can be burnt to aluminium oxide, which can possibly be of importance in obtaining solar energy when, by means of solar energy, aluminium oxide can be reduced and the aluminium can later be burnt again as a source of energy.

Figure 3:
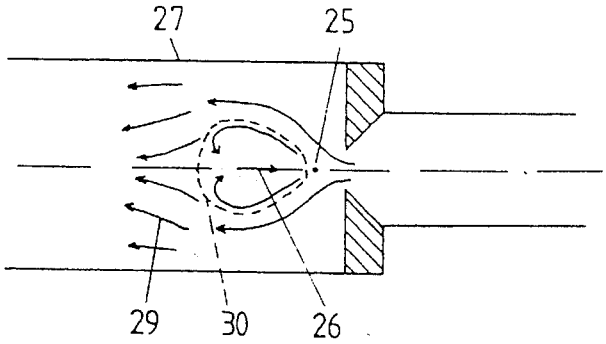
FIG. 3 illustrates the flow picture to prevent a counterflow.

FIG. 3 amplifies how a vortex body is created in front of the exit opening of the vortex chamber, which entirely or almost entirely prevents the counterflow of air. In the drawing in FIG. 3 at point 25, an underpressure is created by the vortex break down, as a result of which the flow, indicated by the arrow 26, threatens to develop. The cone wall 27, however, forces the outflowing gases, the volume of which has considerably increased by the combustion, back to the axis of the tube, as is indicated by the arrows 29. This ensures that the flow 26 remains slight or is even interrupted, while the flow body 30, due to the underpressure at 25 and the underpressure created by the rapid movement of the gases in its immediate vicinity, remains stabilized and is not blown off.

Figure 4:
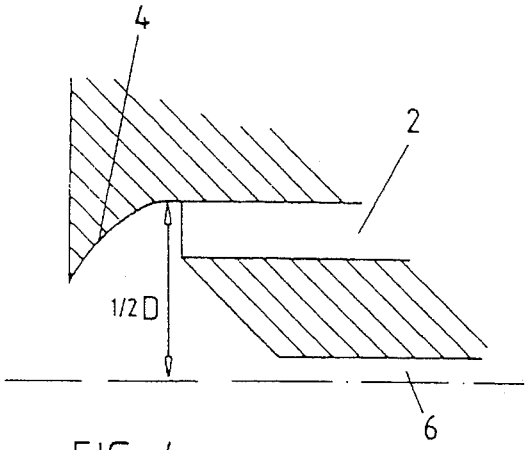
FIG. 4 shows schematically a cross-section of a vortex device in accordance with the invention.

FIG 4. shows a schematic cross-section that represents an advantageous form of the tapering down. It has been found that when the tapering down is too steep it causes a certain thrust and that when it is too flat it takes up too great an axial length and consequently causes too much friction. In the example of FIG. 4 the angle made by the tapering down with the axis at the end of the tapering down is a little smaller than 60 degrees.

Figure 5:
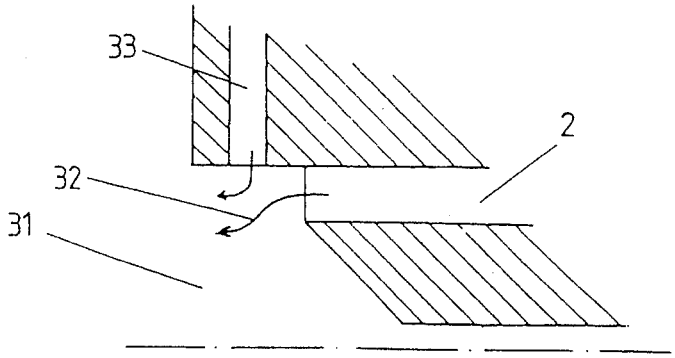
FIG. 5 shows a schematic cross-section of another embodiment.

In FIG. 5 a further example of embodiment is schematically represented. Here, the air-supply slot 2 is shown again, by which axially whirling air enters the space 31, as is indicated by the arrow 32. This arrow bends inwards, because from a ring or annular slot 33 radially inflowing and tangentially whirling gas is introduced, which preferably has an axial velocity as well. This, however, is not shown in FIG. 5. This air forces the whirling air coming out of the annular slot 2 inwards, as a result of which the latter is narrowed and thus causes an expansion of the vortex.

In the case of an annular slot with a width of ⅛ to ¼ of the outside diameter D and that has a narrowing with a diameter of ½ D (see FIGS.1,2 and 4), at an axial velocity in the slot equal to the rotation velocity in situ, a steadily burning burner was obtained with an outside diameter of the slot of 17.5 mm, an inside diameter of the narrowing of 12 mm and a diameter of the burner cone of 90 mm. Such a burner can stand a pressure of introduced combustion air of 1000 $N/m^2$ without running the risk of blowing off.

The invention not only provides a compact and most steady burner, it may also serve to manufacture a spray nozzle with a wide adjusting range. Compared to conventional pressure spray nozzles, such a burner-spray-nozzle has two advantages:

1) At a low oil through-flow, the atomization is better than at a high oil through-flow. As, however, at a high through-flow the flame is longer end therefore takes up more room in which mixing can occur, a constant combustion quality is obtained at a higher and lower oil through-flow.

2) A good air cooling, which prevents the burner from getting dirty and blocked at high temperatures.

For this reason the invention is suitable as a spray nozzle for any type of burner that is to mix fuel with combustion air, for any application with a wide adjusting range.

To elucidate the phenomenon of vortex break down, the following remarks should be noted.

In a rotation-symmetrical two-dimensional continuous flow it is possible to deduce from the equation of continuity $$\vec{\nabla}\cdot\vec{u}-0$$

the existence of a flow function $\phi$:

$$u_z=\frac{1}{r}\cdot\frac{\delta\phi}{\delta r}$$

and $$u_r=-\frac{1}{r}\cdot\frac{\delta\phi}{\delta z}.$$

If no external forces are present, and the influence of the viscosity is neglected, Navier-Stokes becomes:

$$\frac{D\vec{u}}{Dt}=\vec{u}\cdot\vec{\nabla}\vec{u}=-\frac{1}{\rho}\vec{\nabla}p$$

with $$\vec{\omega}=\vec{\nabla}\times\vec{u}$$

for the vorticity, this results in:

$$\vec{u}\times\vec{\omega}=\vec{\nabla}\cdot\left(\frac{p}{\rho}+\frac{1}{2}|\vec{u}|^2\right) \quad (1)$$

The $\phi$-component of (1) gives now $U\phi\cdot r$=constant=$f(\phi)$ if we assume the area around the axis to be an area with 'solid body' rotation, hence $$U\phi-\Omega\cdot r$$

and $$\Omega\cdot r^2-f(\phi)$$

The components of $\vec{\omega}$ now become:

$$\omega_z = u_z \cdot \frac{df}{d\phi}, \quad \omega_r = u_r \cdot \frac{df}{d\phi}$$

and $$\omega_\phi = \frac{f}{r} \cdot \frac{df}{d\phi} - r \cdot \frac{d}{d\phi}\left(\frac{p}{\rho} + \frac{1}{2}|\vec{u}|^2\right)$$

Solving $\omega_\phi$ from (1) and (2) gives $$\frac{\delta^2\phi}{\delta z^2} + \frac{\delta^2\phi}{\delta r^2} - \frac{1}{r} \cdot \frac{\delta\phi}{\delta r} = r^2 \cdot \frac{d}{d\phi}\left(\frac{p}{\rho} + \frac{1}{2}|\vec{u}|^2\right) - f\frac{df}{d\phi}$$

so the flow function $\phi$ is given by $$\frac{\delta^2\phi}{\delta z^2} + \frac{\delta^2\phi}{\delta r^2} - \frac{1}{r} \cdot \frac{\delta\phi}{\delta r} = r^2 \cdot \frac{d}{d\phi}\left(\frac{p}{\rho} + \frac{1}{2}|\vec{u}|^2\right) - f\frac{df}{d\phi}$$

with $f=\Omega r^2$.

Now we want to examine what happens if a flow in a cylinder passes to another cylinder with a larger diameter.

Upstream, in the smallest cylinder, we assume in the vicinity of the axis a velocity $U_0$ in the z-direction, so $$u_z = \frac{1}{r} \cdot \frac{\delta\phi}{\delta r} = U_0 \Rightarrow \phi = \frac{1}{2} U_0 \cdot r^2$$

hence $$f = \Omega \cdot r^2 = \frac{2\Omega}{U_0} \cdot \phi$$

and $$-f\frac{df}{d\phi} = -\left(\frac{2\Omega}{U_0}\right)^2 \cdot \phi.$$

The Bernoulli surfaces in this flow are cylinders, hence the pressure, except for a constant term, is given by $$p(r) = \frac{1}{2}\rho(U_0^2 + u_\phi^2) \sim \frac{1}{2}\rho u_\phi^2.$$

Then $$\frac{p}{\rho} + \frac{1}{2}|\vec{u}|^2$$

except for a constant, is represented by $$\frac{1}{2}U_0^2 + u_\phi^2 = \frac{1}{2}U_0^2 + \Omega^2 \cdot r^2 = \frac{1}{2}U_0^2 + \frac{2\Omega^2}{U_0} \cdot \phi$$

The expression above gives for $$r^2 \cdot \frac{d}{d\phi}\left(\frac{p}{\rho} + \frac{1}{2}|\vec{u}|^2\right):$$

$$r^2\frac{d}{d\phi}\left(\frac{p}{\rho} + \frac{1}{2}|\vec{u}|^2\right) = \frac{2\Omega^2}{U_0} \cdot r^2.$$

The flow function $$\phi(r,z) = \psi(r) \cdot r + \frac{1}{2}U_0 r^2$$

of a rotating flow in a cylinder is therefore determined by $$\frac{d^2\psi}{dr^2} + \frac{1}{r} \cdot \frac{d\psi}{dr} + \left(k^2 - \frac{1}{r^2}\right)\psi = 0, k = \frac{2\Omega}{U_0}$$

a Bessel equation of the order 1.

So for the solution, regular on the axis, we find $$\psi = A \cdot J_1(kr)$$

$$\phi = \frac{1}{2}U_0 r^2 + A \cdot r \cdot J_1(kr)$$

$$u_z = \frac{1}{r} \cdot \frac{\delta\phi}{\delta r} = U_0 + A \cdot k \cdot J_0(kr)$$

$$u_\phi = \frac{f}{r} = \frac{2\Omega}{U_0} \cdot \frac{\phi}{r} = k \cdot \frac{\phi}{r}$$

$$u_\phi = \Omega r + k \cdot A \cdot J_1(kr).$$

Upstream, in the smallest cylinder, we assume an axial velocity $U_0$ in an area with vorticity with a diameter $2r_0$.

Downstream, in the biggest cylinder, we refer to the axial velocity as $U_1$ within the area with vorticity with diameter $2r_1$.

For the upstream and downstream flow functions therefore applies:

$$\frac{1}{2}U_0 r_0^2 = \frac{1}{2}U_0 r_1^2 + A \cdot r_1 \cdot J_1(kr_1)$$

$$A = \frac{U_0(r_0^2 - r_1^2)}{2r_1 \cdot J_1(kr_1)}$$

and $$\frac{u_z}{U_0} = 1 + \left(\frac{r_0^2}{r_1^2} - 1\right) \cdot \frac{\frac{1}{2}kr_1}{J_1(kr_1)} \cdot J_0(kr_1).$$

If we refer to the axial velocity on the edge of the vortex upstream as $U_1$, we find a relation between $U_1$, $U_0$, $kr_0$ and $kr_1$:

$$\frac{U_1}{U_0} = 1 + \left(\frac{k^2 r_0^2}{k^2 r_1^2} - 1\right) \cdot \frac{\frac{1}{2}kr_1}{J_1(kr_1)} \cdot J_0(kr_1).$$

If $kr_0$ is big enough and/or $U_1/U_0$ small enough the above expression will have no solution. In that case 'vortex break down' will occur.

Figure 6:
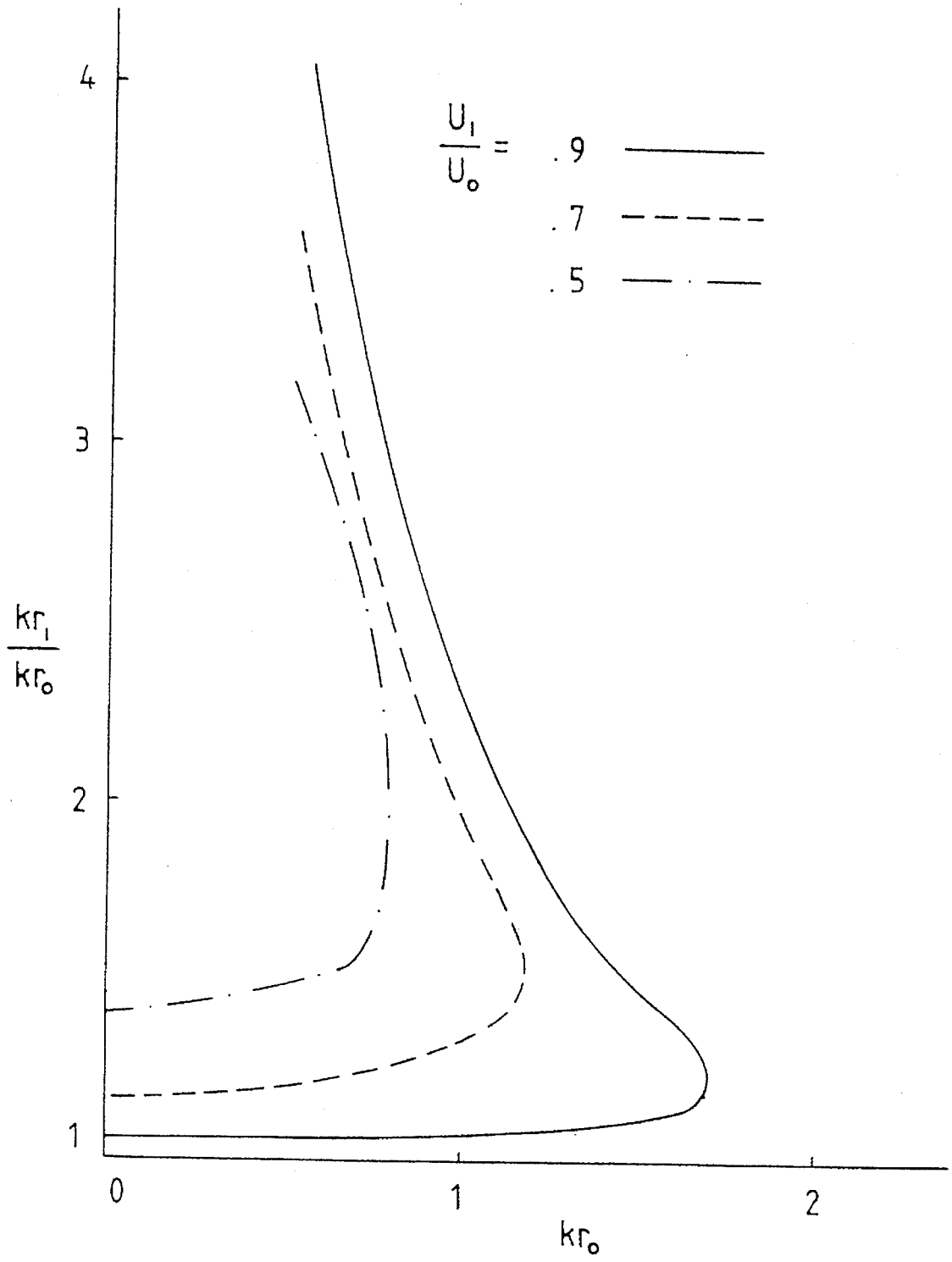
FIG. 6 shows a graph to illustrate the analytical method for determining vortex break down.

In FIG. 6 the value of $kr_1/kr_0$ is plotted as a function of $kr_0$. This shows that initially two solutions are available at a certain value of $kr_0$, subsequently just one in a maximum and finally none at all. In this last domain vortex break down will occur, but it should be taken into account that the flow has always contained smaller vortices which have not been included in the calculation so that the indicated relation can only be regarded as an approximation and cannot be construed as a limitation to the invention.

It is easy to observe vortex break down in a burner, because in that case the combustion takes place in a fairly small torus shaped zone. This zone is calm and hardly moves. When oil constitutes the fuel, this zone will have a blue color if the oil had already been completely gasified. As the temperature rises, this zone will become a deeper blue. In case of a less complete gasification, yellow radiant coal particles may be present in this zone, but experience shows that with a sufficient supply of oxygen, all unburnt soot particles or hydrocarbons in the residual gas are completely burnt.

An important application of the invention is a spray nozzle or atomizer, where the obtained very fine mist, the very thoroughly mixed gas mixture or the very homogeneous suspension of solid particles will not directly be burnt or even not be burnt at all.

It will be clear that the invention is not limited to the pictured and amplified embodiments. For example, it is possible that the mixing substance is brought into rotation prior to coming into contact with the air jet. This is particularly important in the case of mixing with low-calorific gas.

The rotation enforcing body can have any shape, provided that it superimposes a rotation onto the gas flow. In addition, it may also contain moving or rotating parts such as a blade wheel.

I claim:

1. A burner which mixes a combustion air flow with a fuel comprising:

a vortex chamber which is axially symmetric about a longitudinal axis, said vortex chamber including an upstream side at one longitudinal end and a downstream side at the other longitudinal end defining an axial flow direction from the upstream side to the downstream side, a central opening at the downstream side, a tapering portion which tapers from a maximum radial inside diameter provided between the upstream and downstream side to a radial inside diameter at the central opening which is 70–90% of the maximum radial diameter, a feed means for feeding combustion air into said vortex chamber to create a rotational movement of the combustion air about the longitudinal axis, said feed means including a plurality of openings through which the combustion air is fed to said vortex chamber, said openings being located at a periphery of said vortex chamber immediately upstream from the tapering portion, a fuel inlet located at or upstream of said openings such that mixing of the rotating combustion air fed through the openings with fuel from the fuel inlet in said vortex chamber creates a vortex flow pattern of a fuel/air mixture about the longitudinal axis in said vortex chamber; and a flame room fluidly connected with the central opening at the downstream side of said vortex chamber, said flame room including an inside diameter directly adjacent the central opening of said vortex chamber which is at least 2.5 times greater than the minimum radial inside diameter of the central opening whereby the conditions in the flame room are such that the vortex flow pattern of the fuel/air mixture breaks down upon entry of the fuel/air mixture into said flame room and combustion of the fuel/air mixture takes place in a substantially toroidal zone in the flame room.

2. Burner according to claim 1, wherein the equation:

$$\frac{U_1}{U_0} = 1 + \left( \frac{k^2 r_0^2}{k^2 r_1^2} - 1 \right) \cdot \frac{\frac{k}{2} r_1}{J_1(kr_1)} \cdot J_0(kr_1)$$

wherein, $U_0$=axial velocity at the end of the tapering down portion;

$U_1$=axial velocity in the flame room;

$k=2\Omega/U_0$ with $\Omega$=the angular velocity and $J_0$ and $J_1$ are Bessel functions of the zeroth and first order; has no real solution whereby vortex breakdown in the flame room occurs.

3. Burner according to claim 1, wherein the flow into the vortex chamber has a tangential component and an axial component and in which the tangential component of the flow introduced into the vortex chamber is at least equal to the axial component.

4. Burner according to claim 1, wherein the tapering portion includes at its narrowest end an angle with the longitudinal axis of the burner of over 50 degrees.

5. Burner according to claim 1, wherein in the center of a surface closing the central region of the feed means for feeding combustion air an inlet is present for a liquid or pulverized fuel, which fuel can move along said surface to the openings of the feed means for feeding combustion air.

6. Burner according to claim 5, wherein said surface is a cone directed against the axial flow direction.

7. Burner according to claim 1, wherein the diameter of the flame room is at least five times the diameter of the central opening in the tapering portion.

8. Burner according to claim 1, wherein the flame room includes a sub pressure area adjacent the central opening of the vortex chamber where vortex breakdown occurs and an end area located further from the central opening than the sub pressure area and said flame room is tapered such that a stable gas body is formed, which gas body prevents gas from flowing back from the end area of the flame room to the sub pressure area formed by the vortex breakdown.

9. Burner according to claim 1, wherein the flame room includes a rear wall located adjacent the central opening of the vortex chamber such that fluid connection of the flame room to the central opening is through the rear wall and means are present to cool the rear wall.

10. Burner according to claim 1, wherein the flame room includes a rear wall located adjacent the central opening in the vortex chamber such that fluid connection of the flame room to the central opening is through the rear wall and wherein an air slot in the flame room is present near the rear wall.

11. Burner according to claim 1, wherein a controllable air tap is present, for air that has entirely or partially passed through the feed means for feeding combustion air.

12. Burner according to claim 1, wherein means are provided to admix a pulverized substance into the air fed to the vortex chamber by the feed means for feeding combustion air.

13. A method for mixing a combustion air flow with a gaseous, liquid or pulverized fuel in order to burn it, comprising the steps of:

a) feeding a combustion air flow with a rotational component to an axially symmetric vortex chamber at the periphery of said chamber, said vortex chamber having an upstream side, a downstream side, a longitudinal axis and a central opening fluidly connected at the downstream side to a flame room having a diameter of at least 2.5 times the diameter of the central opening at the downstream side of the central opening of the vortex chamber; and b) contacting the combustion air flow with a gaseous flow which is introduced upstream of, or at, the point where the combustion air flow is fed to the vortex chamber and which contains fuel and air with an inwardly directed radial component to cause contraction of the axial cross-section of the combustion air flow to 70–90% of the cross-section thereof at the largest diameter portion of the vortex chamber to thereby create a vortex flow pattern of the fuel/air mixture about the longitudinal axis of the vortex chamber.

* * * * *